US007017232B1

(12) United States Patent
Priddy

(10) Patent No.: US 7,017,232 B1
(45) Date of Patent: Mar. 28, 2006

(54) LOAD LIMITING HINGE

(76) Inventor: Thomas G. Priddy, 125 Carefree Cir., Lakeway, TX (US) 78734

( * ) Notice: Subject to any disclaimer, the term of this patent is extended or adjusted under 35 U.S.C. 154(b) by 0 days.

(21) Appl. No.: 11/123,015

(22) Filed: May 6, 2005

(51) Int. Cl.
*E05F 1/08* (2006.01)

(52) U.S. Cl. ..... 16/286; 16/297

(58) Field of Classification Search ..... 16/286, 16/222, 233, 281, 256, 278, 322, 355, 374, 16/375, 297, 343, 321, 362, 331, 289; 126/190–194; 49/386

See application file for complete search history.

(56) References Cited

U.S. PATENT DOCUMENTS

| | | | | | |
|---|---|---|---|---|---|
| 2,823,661 | A | * | 2/1958 | Grannan | 126/191 |
| 3,643,755 | A | * | 2/1972 | Gionet et al. | 180/69.21 |
| 3,712,287 | A | * | 1/1973 | Summers, Jr. | 126/191 |
| 3,749,080 | A | * | 7/1973 | Kleinhenn | 126/191 |
| 3,842,542 | A | * | 10/1974 | White et al. | 49/386 |
| 4,115,901 | A | * | 9/1978 | Schmidt | 16/374 |
| 4,131,970 | A | * | 1/1979 | Le Van | 16/270 |
| 4,163,344 | A | * | 8/1979 | Scherer | 49/386 |
| 4,194,321 | A | * | 3/1980 | Hess | 49/389 |
| 4,269,165 | A | * | 5/1981 | Wrotny et al. | 126/191 |
| 4,287,873 | A | | 9/1981 | Goins et al. | |
| 4,340,991 | A | | 7/1982 | Gidseg | |
| 4,665,892 | A | | 5/1987 | Spargo et al. | |
| 4,817,240 | A | * | 4/1989 | Sovis et al. | 16/297 |
| 5,025,776 | A | | 6/1991 | Hanley et al. | |
| 5,291,634 | A | * | 3/1994 | Zanetti | 16/333 |
| 5,341,542 | A | | 8/1994 | Hannan et al. | |
| 5,815,379 | A | | 9/1998 | Mundt | |
| 5,937,481 | A | * | 8/1999 | Faringosi | 16/332 |
| 5,940,934 | A | | 8/1999 | Turner | |
| 6,035,848 | A | * | 3/2000 | Ray et al. | 126/194 |
| 6,058,566 | A | | 5/2000 | Kerr et al. | |
| 6,130,822 | A | | 10/2000 | Della Fiora et al. | |
| 6,711,781 | B1 | | 3/2004 | Hsiu | |
| 6,892,424 | B1 | * | 5/2005 | Habegger et al. | 16/289 |
| 2003/0221285 | A1 | * | 12/2003 | Habegger et al. | 16/297 |
| 2004/0172787 | A1 | | 9/2004 | Collene et al. | |

FOREIGN PATENT DOCUMENTS

| | | | | |
|---|---|---|---|---|
| DE | 10152907 | A1 | * | 9/2002 |
| EP | 565809 | A1 | * | 10/1993 |
| EP | 959213 | | | 11/1999 |
| GB | 2235723 | A | * | 3/1991 |
| GB | 2292181 | A | * | 2/1996 |

* cited by examiner

*Primary Examiner*—Chuck Y. Mah
*Assistant Examiner*—Mark T. Vogelbacker
(74) *Attorney, Agent, or Firm*—Richard C. Litman

(57) ABSTRACT

The load limiting hinge provides a rigid, essentially inelastic drop down door mounting structure when normal loads are placed upon the door, but includes an easily replaceable weak link or "mechanical fuse" which breaks or opens when excessive force is applied to the open door. The hinge assembly supports the drop down door with practically no deflection of the door or hinge assembly when normal loads are applied to the open door, but allows the door to drop from the horizontal when excessive loads are applied to the door, to preclude the tipping of an appliance to which the door is attached or the continued use of the door as a platform. The hinge assembly is particularly useful in oven door installations, serving to assure that hot articles atop the stove are not spilled due to tipping of the appliance or inappropriate access by small children.

18 Claims, 9 Drawing Sheets

LOAD LIMITING HINGE

BACKGROUND OF THE INVENTION

1. Field of the Invention

The present invention relates generally to hinges and similar attachments. More specifically, the present hinge is configured particularly for use with a "drop down" oven door (although it is adaptable to other structures), and acts to release the door suddenly and rapidly from its fully open horizontal position in the event that an excessive load is placed upon the door. This function prevents tipping of the oven due to the door acting as a lever, and/or the use of the door as a step by a child to access the top of the stove.

2. Description of the Related Art

Most household ovens are constructed with a "drop down" oven door, i.e., the door is hinged along its lower edge or at the ends thereof. This allows articles, such as large pans, oven racks, etc., to be placed on the inner surface of the oven door when the door is fully lowered to its horizontal position as the article is moved into or from the oven proper, as in normal use of the oven. However, ovens and oven doors are also subject to abnormal use, i.e., an excessively high load being placed on the oven door. This may occur in the event of one or more toddlers or small children using the oven door as a step to reach for something on the range top of the stove. While this is by no means a proper use of the oven and door, it nevertheless may happen from time to time. A number of tragedies in which one or more small children have spilled hot liquids, oils, etc., on themselves from the range top of a stove have been documented in the past. Free-standing range/oven appliances are designed to be firmly anchored to the adjacent building structure, but anchors are often not installed, perhaps in the majority of oven installations. As a result, even if the door structure remains intact structurally, with no deformation or breakage, the entire oven may tip, causing articles atop the stove to slide forward.

As a result, ANSI (American National Standards Institute) and UL (Underwriters Laboratories) have developed standards for oven doors for both normal and abnormal use. The ANSI standard is Z21.1, directed to gas ranges, while UL standard 858 covers electric ovens and ranges. The normal test requires that the oven door support, without the oven tipping, a 75-pound load applied mid-span of an open oven door with a maximum of one-half inch deflection of the door at six inches from the hinge line of the door. This normal requirement assures that the door will support a normal load thereon, e.g., a large turkey or roast, etc., without the door or hinge structure bending and deflecting sufficiently to allow the load to slide off and drop to the floor. The loading for this test is well below that required by safety standards to prevent tipping of the oven or damage to the door structure, and in fact the normal use test requires that the door survive the test without breakage or damage.

The abnormal use test is intended to assure that the oven will remain upright when a load of up to 250 pounds is placed on the door, as when one or more toddlers or small children may open the door and use it as a step to access the top of the stove. In the abnormal use test, deformation, deflection, and breakage of the door, door hinge structure, attachment structure, etc., is permissible, so long as the door has passed the 75-pound load test for normal use. The primary concern here is that an article placed upon the cook top of the stove should not slide off the top of the stove due to tilting of the stove or oven during this test. The oven is, of course, firmly anchored to the underlying structure during the abnormal use test, with this test serving to check the anchoring system and overall rigidity of the oven structure.

However, it is recognized that a large number of ovens, likely the majority, are not properly anchored to the floor during installation, even where such anchoring is required by building codes. As a result, it is possible for an oven that passes the abnormal use test with the door and hinge structure intact to tip if a large load is placed upon the door. The tragedy that may result from this if small children climb upon the door and spill hot oil or other liquids upon themselves, or if the entire oven tips forward toward them to allow hot liquids to be dumped onto them from the range top surface, has been noted further above.

A number of different oven door hinge configurations have been developed in the past as a response to the above problem. In some cases, a supplemental spring(s) is used to allow the door to open past the horizontal when an excessive load is placed upon the door. However, due to the spring constant, the door will lower only slightly beyond the horizontal when a weight only slightly exceeding the predetermined maximum for the horizontal door, is placed thereon. Thus, no substantial deflection of the door from the horizontal is provided with such a configuration until a weight substantially greater than the predetermined maximum for the horizontal door is placed thereon. It is difficult to design a door using such a supplemental spring configuration which will remain undeflected from the horizontal while supporting a load of 75 pounds, and yet will allow the door to drop down significantly when a load only slightly greater, i.e., a toddler or small child, places his or her weight upon the door. Some oven doors are designed with a spherical fitting that pulls through a slot extending from a socket in order to widen the slot and spread the jaws when excessive load is placed upon the assembly. In this structure, the deformation of the slot permits a slow deflection of the door assembly well before the point is reached where the fitting separates from its attachment point.

There is a need for a hinge configuration for a "drop down" oven door having a hinge axis along its lower edge, in which the hinge configuration precludes any breakage or substantial deformation of the door and hinge structure in testing according to ANSI and UL standards of normal use. Moreover, the hinge configuration should provide a sudden failure mode, allowing the door to drop completely until its distal edge contacts the underlying surface, or the door is stopped in some other manner, when a single, simple, easily replaced part (which may be considered to be a "mechanical fuse") fails at a predetermined load in abnormal use testing. The sudden failure mode must remain completely intact with no significant deflection until sufficient force is applied to cause the sudden and complete failure of the "mechanical fuse."

Thus, a load limiting hinge solving the aforementioned problems is desired.

SUMMARY OF THE INVENTION

The load limiting hinge is used to attach a drop down door to the fixed structure of an oven or other appliance. The hinge is assembled upon a hinge post made from a rigid, substantially inelastic structure, a hinge post being bolted, riveted, welded, or otherwise immovably attached to the fixed structure of the oven on each side of the door opening. A hinge plate is secured to each hinge post, with the hinge plate providing attachment for the door arm. The hinge plate is normally fixed in position by a bolt or the like having a necked down cross section at one point, thereby providing a "weak link" in the assembly. This hinge plate securing bolt may be considered as a "mechanical fuse," in that it operates much like an electrical fuse by allowing normal operation so long as loads do not exceed a predetermined value, but breaks or opens when the load exceeds that predetermined level.

At this point, the hinge plate pivots about its pivotal attachment point to the hinge post, allowing the door arm to drop the distal edge of the attached door to the underlying surface or other stop. The hinge plate has an arcuate slot therein with a narrower width at the distal end of the slot, thereby frictionally gripping the shank of a fastener captured within the slot as the hinge plate pivots after breakage of the attachment bolt. This prevents the door from swinging upwardly by means of the balance spring and slider mechanism incorporated therewith.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a load limiting door hinge that provides essentially rigid and undeformed extension of the door to which it is attached under normal loads and use, but permits the door to break away beyond its normally fully opened position in the event of an excessive load thereon. The weak link or "mechanical fuse" used to permit the door to break away under a predetermined load is quickly, easily, and inexpensively replaced in the event that it is broken. While the hinge may be adapted to a wide range of door attachments, it is particularly useful with "drop down" type oven doors and the like.

Figure 1:
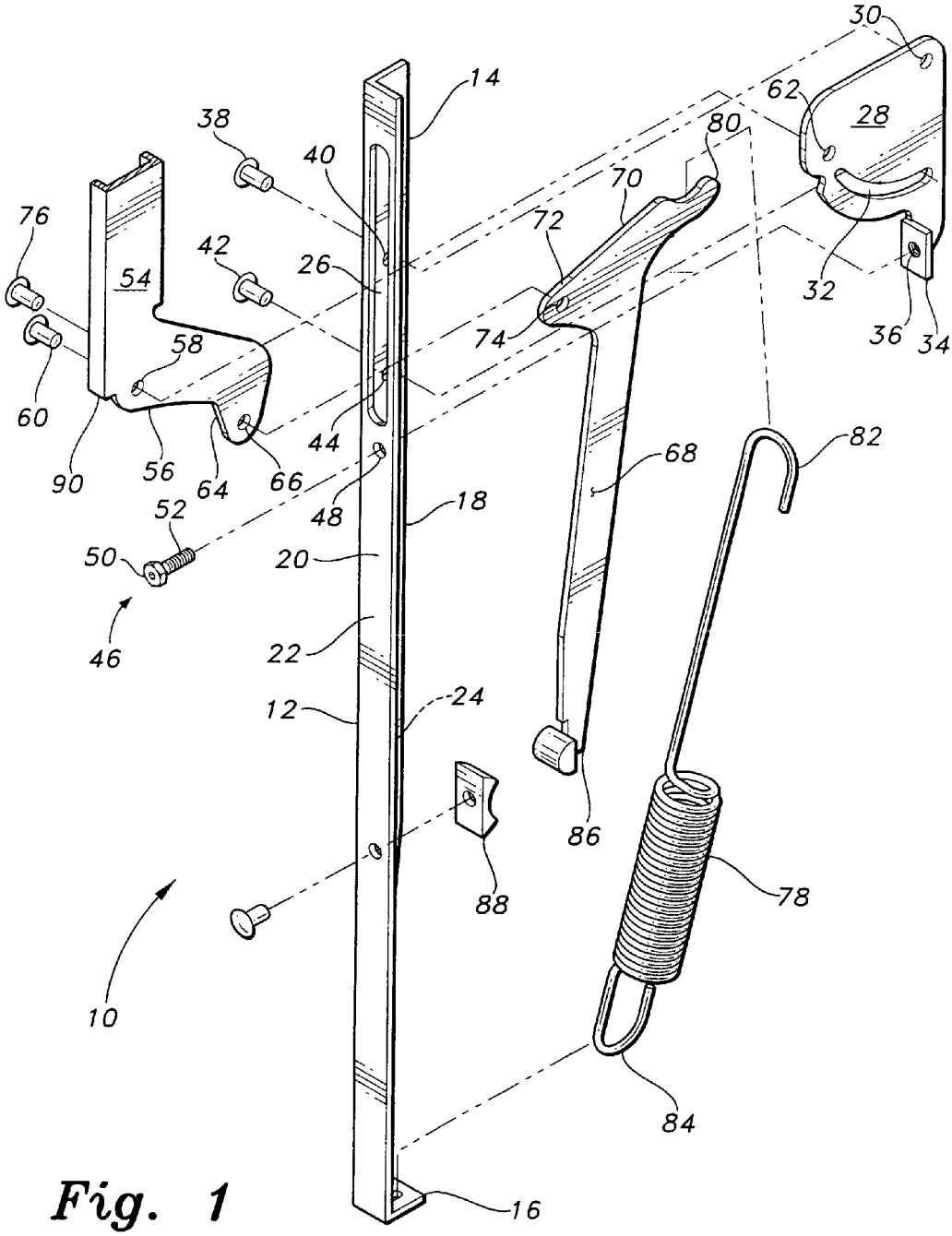
FIG. 1 is an exploded perspective view of a load limiting hinge according to the present invention, showing its various components and their interrelationships.

FIG. 1 of the drawings provides an exploded perspective view of the various components forming the present hinge assembly 10. The hinge assembly 10 utilizes a unitary, monolithic, elongate, and substantially rigid hinge post 12, preferably formed of relatively thick steel, in order to provide the required structural rigidity and resistance to bending. The hinge post 12 includes a hinge plate attachment portion 14 and an opposite door spring attachment end 16, with the door spring attachment end 16 including a spring attachment tab and hole located at the lower end of the post 12 when the hinge assembly 10 is installed with a drop down type door installation.

The hinge post 12 may be formed of a length of "angle iron" stock material, i.e., having a hinge plate attachment wall 18 (more clearly shown in FIGS. 2A through 2D), upon which the hinge plate is pivotally mounted (when the door is overloaded) and a hinge plate locking wall 20 (through which the "mechanical fuse" passes to secure the hinge plate in position under normal loads), with the two walls 18 and 20 essentially normal to one another. The hinge plate locking wall 20 further includes a door arm extension side 22, i.e., the side or surface facing the door when the hinge assembly is installed and from which the door arm extends, and an opposite hinge plate attachment side 24 (more clearly shown in FIGS. 2A through 2D), with the mechanical fuse component securing the hinge plate thereagainst. A door arm and hinge plate clearance slot 26 is also formed through the hinge plate locking wall 20, with the hinge attachment end of the door arm and a portion of the hinge plate passing through the slot 26.

A generally flat, substantially rigid hinge plate 28 is formed of a relatively thick piece of strong metal in order to preclude any significant bending or deformation thereof when high loads are placed upon the hinge assembly 10. The hinge plate 28 includes a pivot attachment hole 30 and an arcuate pivot limit slot 32 formed therethrough, with the arc of the pivot limit slot 32 being defined by the pivot attachment hole 30. The hinge plate 28 also includes a mechanical fuse attachment lug 34 extending substantially normal to the main expanse of the plate 28, with a threaded mechanical fuse attachment hole 36 formed through the lug 34.

The plate 28 is secured to the hinge post 12 by a series of three fasteners, i.e., a hinge plate pivot fastener 38 which passes through a hinge plate pivot hole 40 formed through the hinge plate attachment wall 18 of the hinge post 12 and the pivot attachment hole 30 of the hinge plate 28; a hinge plate pivot limit fastener 42 which passes through the pivot limit slot 32 of the hinge plate 28 and through a hinge plate pivot limit fastener hole 44 formed through the hinge plate attachment wall 18 of the hinge post 12; and a threaded "weak link" or "mechanical fuse" 46, which passes through a hinge plate locking hole 48 formed through the hinge plate locking wall 20 of the hinge post 12 to thread into the mechanical fuse attachment hole 36 of the hinge plate 28. The pivot limit slot 32 and pivot limit fastener 42 combine to both guide and limit pivoting of the hinge plate 28 upon fracture of the fuse 46, as described below. The mechanical fuse 46 includes a head 50 positioned against the front or door arm extension side 22 of the hinge plate locking wall 20 of the hinge post 12, and a threaded shank 52 engaging the locking lug 34 of the hinge plate 28 in tension to grip the locking lug 34 securely against the hinge plate locking wall 20 of the hinge post 12 in normal operation of the hinge assembly 10.

An elongate, substantially rigid and inflexible door arm 54 has a hinge plate attachment end 56 with a hinge plate attachment hole 58 therethrough, through which a door arm pivot fastener 60 passes to secure the door arm 54 to the hinge plate 28 by means of a door arm attachment hole 62 formed through the hinge plate 28. The door arm 54 also includes a laterally offset slider bar attachment arm 64 with a slider bar attachment hole 66 therethrough. An elongate, substantially rigid and inflexible slider bar 68 includes a door arm attachment end 70 with a laterally offset door arm attachment lug 72 extending therefrom. The door arm attachment lug 72 has a door arm attachment hole 74 formed therethrough, with a door arm and slider bar connection fastener 76 passing through the slider bar attachment hole 66 of the door arm 54 and the door arm attachment hole 74 of the slider bar 68 to secure the door arm 54 to the slider bar 68.

The various fasteners used to assemble the hinge assembly 10, i.e., the hinge plate pivot fastener 38, hinge plate pivot limit fastener 42, door arm pivot fastener 60, and door arm to slider bar connection fastener 76, may comprise threaded bolts secured by corresponding conventional nuts, if so desired. However, the fasteners 38, 42, 60, and 76 are preferably rivets, as the shop heads of such rivets may be compressed to a relatively low height to provide greater clearance between the closely overlapping hinge plate 28, door arm 54, and slider bar 68, and the edges of the clearance slot 26 formed through the hinge plate locking wall 20 of the hinge post 12 and through which the hinge plate 28, door arm 54, and slider bar 68 at least partially pass.

The slider bar 68 and its tension spring 78 serve to counteract the weight of an open drop down door, weakly biasing the door to the closed position and thus facilitating lifting the door for closure. The slider bar 68 includes a laterally offset spring attachment arm 80 extending from the door arm attachment end 70, opposite the door arm attachment lug 72 thereof. The tension spring 78 includes a slider bar attachment arm hook 82 which secures about the spring attachment arm 80 of the slider bar, and an opposite hinge post attachment hook 84 which secures to the spring attachment end 16 of the hinge post 12. The spring 78 is in tension, urging the slider bar 68 toward the spring attachment end 16 of the hinge post 12, and thus drawing the slider bar attachment arm 64 of the door arm 54 downward to rotate the door arm 54 upwardly to its closed position, generally as shown in FIG. 2A of the drawings.

The slider bar 68 may also include a hinge post contact end 86 having a protuberance extending therefrom, which slides upon the hinge plate attachment side or surface 24 of the hinge plate locking wall 20 of the hinge post 12 as the slider bar 68 moves when the door arm 54 swings open and closed. The protuberance also engages a detent 88 which is secured to the hinge post 12, thus lightly securing the door arm 54 (and door which is attached thereto) in a closed position. Opening the door (and thus pivoting the arm 54 away from the hinge post 12) pulls the protuberance at the hinge post contact end 86 of the slider bar 68 over the raised side of the detent 88, thereby allowing the door to open freely.

Figure 2A:
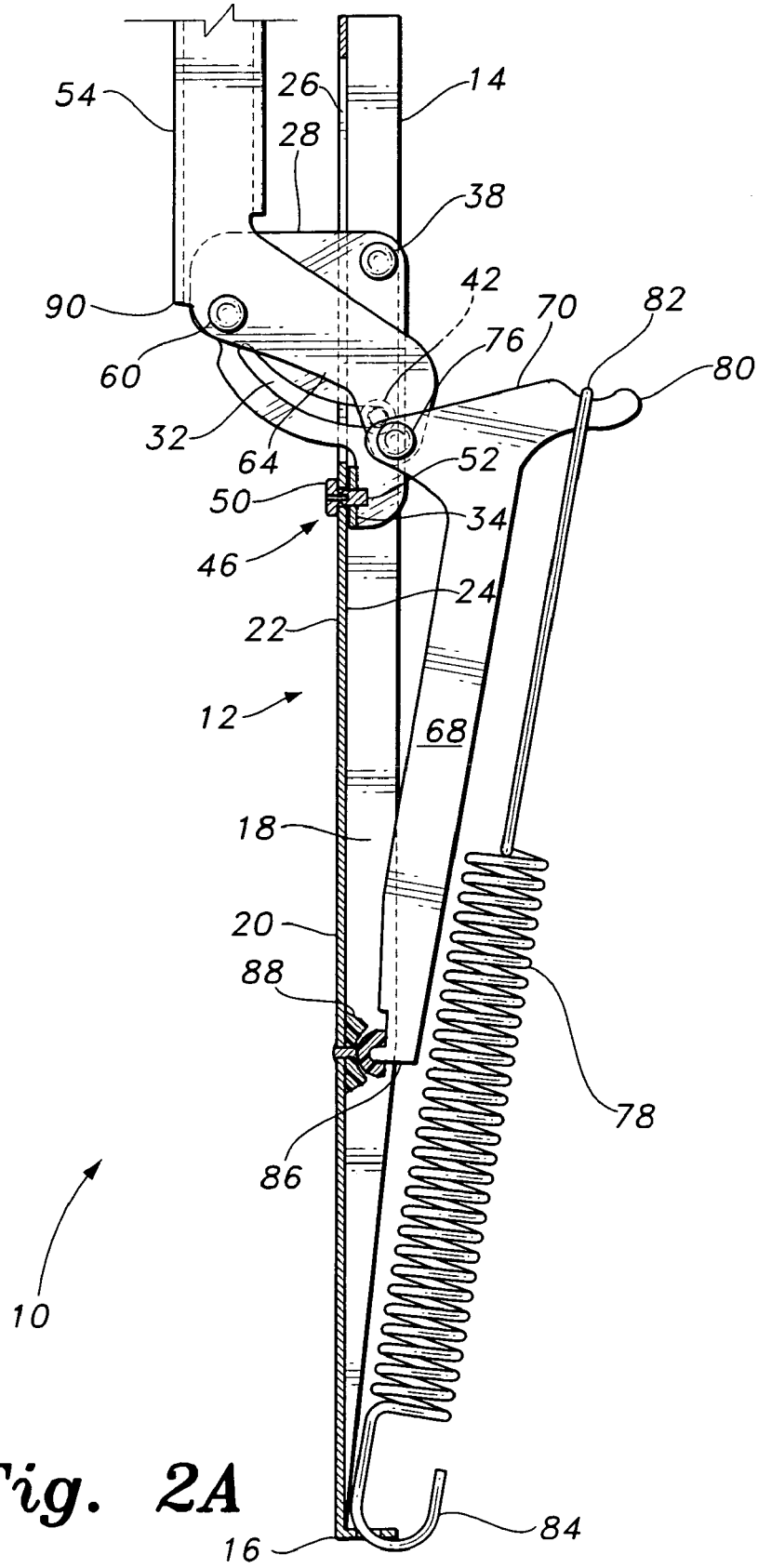
FIG. 2A is a side elevation view in partial section of a load limiting hinge assembly of the present invention, with the drop down door shown in a closed position, gaskets and other structure being omitted for clarity.
Figure 2B:
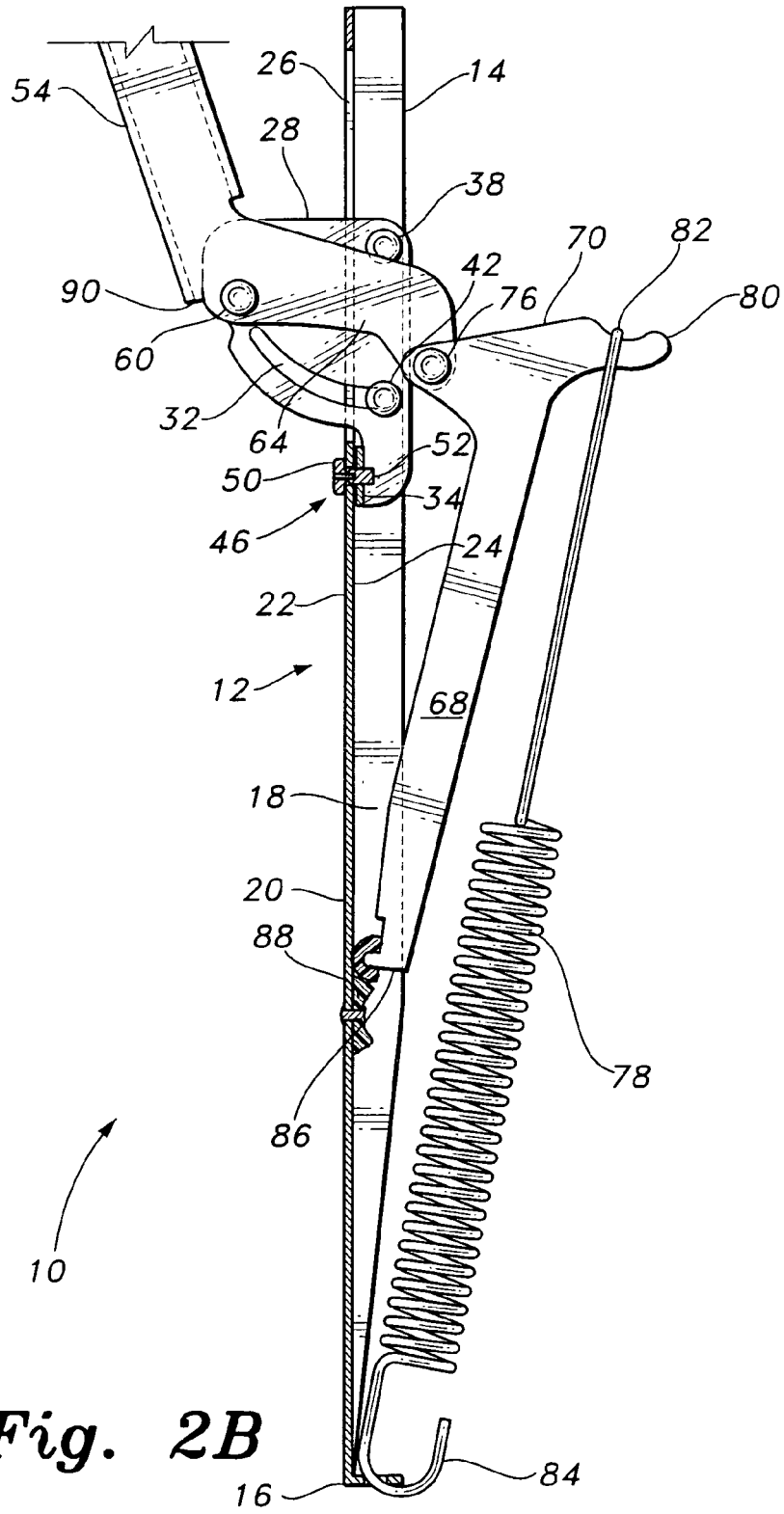
FIG. 2B is a side elevation view in partial section of the present hinge assembly, showing the drop down door partially opened.
Figure 2C:
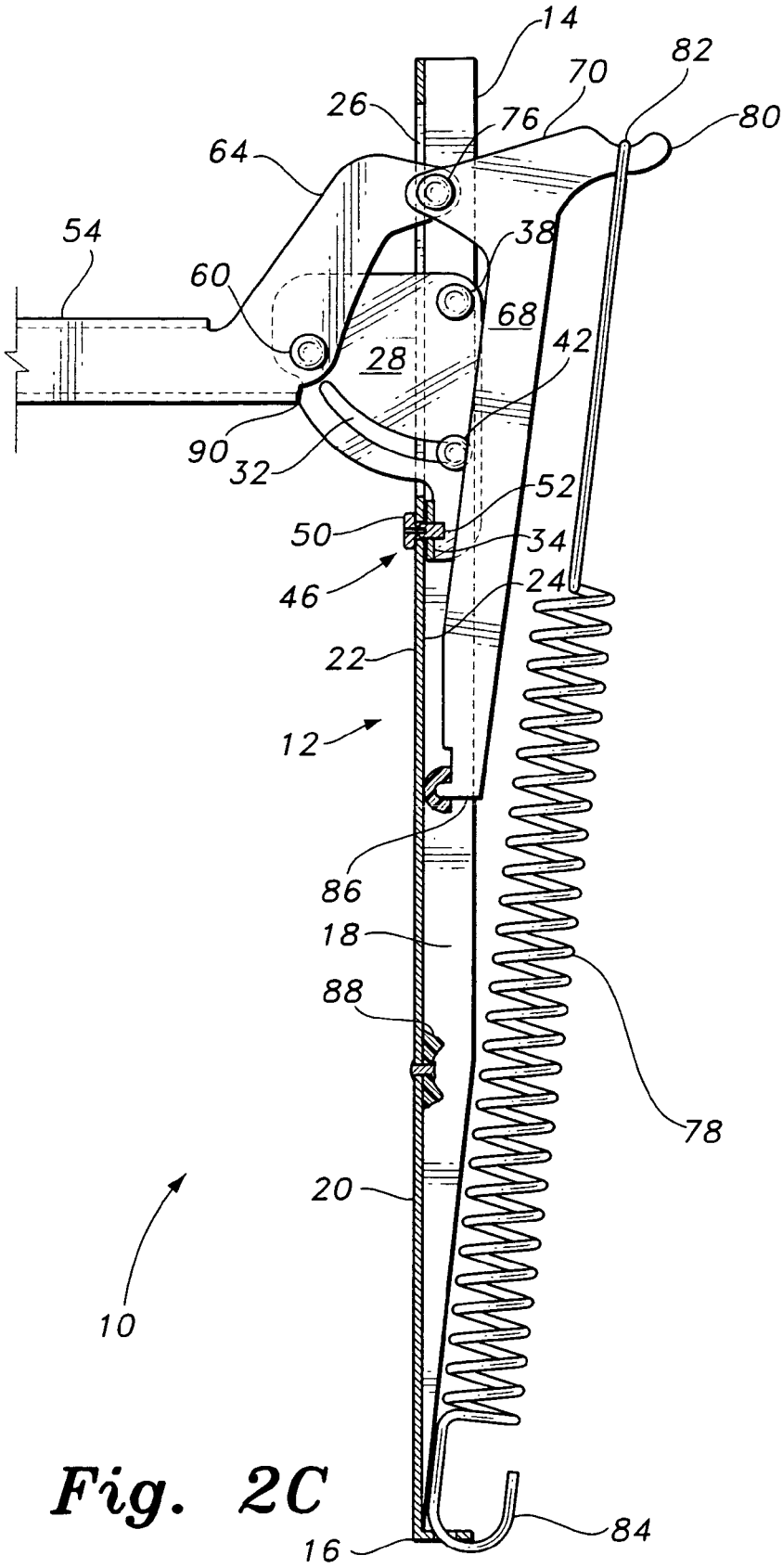
FIG. 2C is a side elevation view in partial section of the present hinge assembly, showing the drop down door opened to its normal fully-opened, substantially horizontal position.
Figure 2D:
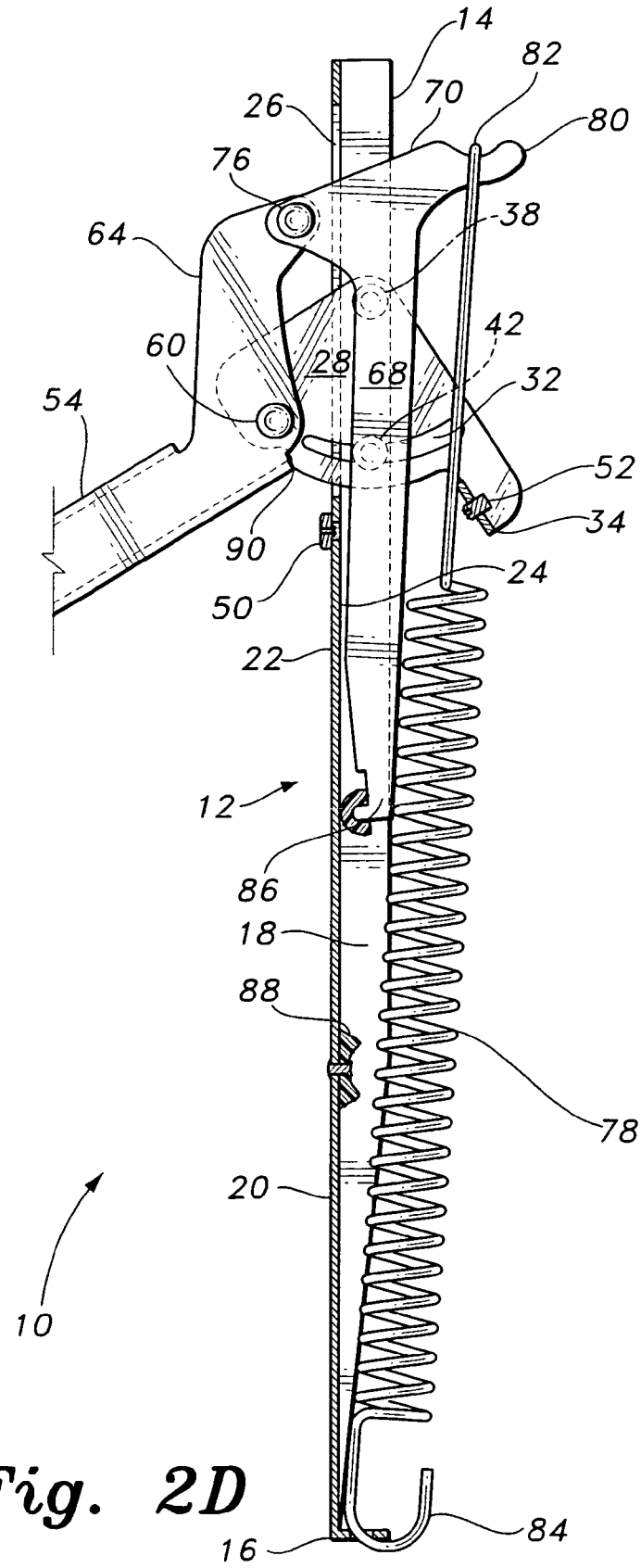
FIG. 2D is a side elevation view in partial section of the present hinge assembly, showing the result of application of excessive force to the door and the separation of the mechanical fuse of the assembly, allowing the distal edge of the door to drop further.

FIGS. 2A through 2C illustrate the normal operation of the present load limiting hinge 10, with FIG. 2D providing an illustration of the hinge assembly 10 after an abnormally high load has been placed upon the door arm 54 to fracture the weak link or mechanical fuse bolt 46. In FIG. 2A, the door arm 54 is extended upwardly, parallel to the hinge post 12. This is the configuration of the hinge assembly 10 when a door extending from the door arm 54 is closed. The slider bar attachment arm 64 of the door arm 54 extends through the slot 26 formed through the hinge post 12, and is drawn toward the door spring attachment end 16 of the hinge post 12 by the slider bar 68 and tension spring 78. The hinge plate 28 is secured to the hinge post 12 at three points, i.e., the hinge plate pivot fastener 38 and hinge plate pivot limit fastener 42, which pass through the hinge plate attachment wall 18 of the hinge post 12, and the weak link or mechanical fuse 46 disposed normal to the two fasteners 38 and 42 and passing through the hinge plate locking wall 20 and mechanical fuse attachment lug 34 of the hinge plate 28.

In FIG. 2B, the hinge arm 54 is swung away from the hinge post 12, as would be the case when a door attached to the hinge arm 54 is partially opened. The slider bar 68 has been drawn slightly upwardly against the tension of the spring 78, moving the hinge post contact end 86 of the slider bar 68, and its protuberance, past the edge or lip of the detent 88. The hinge plate 28 remains in its normal position on the hinge post 12, with the attachment lug 34 secured firmly against the hinge plate attachment side or surface 24 of the hinge plate locking wall 20 of the hinge post 12 and the mechanical fuse link 46 remaining intact.

In FIG. 2C, the door arm 54 has been swung downward to its normally fully opened position. The door arm 54 includes a stop 90, which comes into contact with the outer edge of the hinge plate 28 when the door arm 54 reaches its normally fully opened position, substantially perpendicular to the hinge post 12. When this occurs, further movement of the door arm 54 is precluded relative to the hinge plate 28, with the door arm 54 and hinge plate 28 essentially becoming a locked assembly at this point. The hinge plate 28 is precluded from movement relative to the hinge post 12 due to the mechanical fuse link 46, which secures the hinge plate lug 34 against the hinge plate locking wall 20 of the hinge post 12 and prevents the hinge plate 28 from pivoting about its fastener 38.

The mechanical fuse link 46 is configured to break at some predetermined load, as discussed in greater detail further below, but is sufficiently strong to hold the hinge plate 28 in its normal position as shown in FIGS. 2A through 2C. This assembly should be capable of meeting the requirements of ANSI standard is Z21.1 (gas ranges) and UL standard 858 (electric ovens and ranges) for normal use, i.e., the door cannot deflect more than one-half inch when a 75-pound load is placed six inches from the hinge line of the door. This allows the door to safely support a normal load thereon, e.g., a large turkey or roast, etc., as it is placed upon an open oven door when placing the item into the oven or removing it from the oven. The relatively thick and rigid materials of which the components of the present hinge assembly 10 are formed assure that the door will remain essentially undeflected and undamaged.

A 75-pound load, as used in checking for door deformation or damage in normal loading tests, is by safety standard requirements insufficient to cause even an unanchored standard size oven to tip. However, greater loads imposed upon the door may cause an unanchored oven to tip forward, or may produce sufficient stress to twist the structure and tilt the cook top of the oven and range slightly, even when the legs of the oven are anchored. The load limiting hinge 10 provides a solution to this problem by means of the mechanical fuse or weak link 46 which secures the hinge plate 28 in place on the hinge post 12, as shown in FIGS. 2A through 2C. The door arm 54 transfers all forces imposed thereon to the hinge plate 28 by means of the stop 90 of the door arm 54 bearing against the edge of the hinge plate 28 when the door arm 54 is in its fully opened position relative to the hinge plate 28, as shown in FIG. 2C. These forces in turn produce a moment defined by the forces and the arm between the hinge plate pivot fastener 38 and the mechanical fuse 46.

The fastener 46 is properly termed a "mechanical fuse," as it is analogous to a conventional electrical fuse. The mechanical fuse 46 completely transfers all normal loads thereacross, allowing the hinge assembly 10 to function normally. This is analogous to the operation of electrical fuses in electrical circuits. However, both the mechanical fuse 46 and conventional electrical fuses are specifically configured so that their respective mechanical or electrical force transmitting paths separate, or open, when the mechanical or electrical load reaches a certain predetermined limit. The electrical fuse opens by melting to protect the rest of the circuit, while the present mechanical fuse 46 breaks in tension to preclude damage to the rest of the structure.

When the moment exceeds a certain predetermined load, the mechanical fuse 46 will fracture in tension, thus allowing the hinge plate 28 to swivel or pivot about its hinge plate pivot fastener 38, generally as shown in FIG. 2D of the drawings. As the door arm 54 is still positionally locked relative to the hinge plate 28 due to the door arm stop 90 engaging the edge of the hinge plate 28, the excessive force upon the door arm 54 results in the door arm rotating the hinge plate 28 about its hinge plate pivot fastener 38, allowing the door arm 54 to drop past the horizontal. The arcuate slot 32 in the hinge plate 28 is preferably sufficiently long as to allow the hinge plate 28 and door arm 54 to pivot significantly past the horizontal, with the door extending from the arm 54 being stopped by the underlying surface upon which the oven is resting.

The configuration of the load limiting hinge 10 positions the head 50 of the frangible fastener 46 to the front surface of the oven or other structure in which the hinge 10 is installed, i.e., immediately adjacent the hinge line of the door extending from the door arm 54. Thus, the broken fastener or mechanical fuse is readily accessible and easily removed and replaced when required. One need only remove the head 50 from its position at the hinge plate locking hole (FIG. 1) in the hinge post 12, if it has not previously fallen away when the mechanical fuse 46 separated. The door (and door arm 54) is raised, and the hinge plate 28 is rotated or pivoted back to its normal position as shown in FIGS. 2A through 2C. This positions the shank 52 of the fastener or mechanical fuse 46 where it may be accessed from the front of the assembly.

Figure 3A:
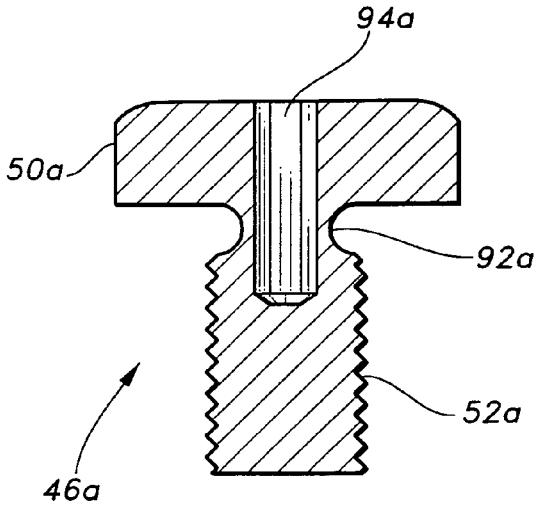
FIG. 3A is an enlarged side elevation view in section of a first embodiment of a mechanical fuse bolt for use in a load limiting hinge assembly of the present invention, showing details thereof.

Preferably, the shank 52 of the mechanical fuse 46 is configured to facilitate removal, as in some of the examples shown in FIGS. 3A through 3C and described below. FIG. 3A illustrates an elevation view in section of a mechanical fuse embodiment 46*a*. The mechanical fuse 46*a* includes an externally wrenched head 50*a*, e.g., having a hexagonal or square head 50*a*, with a circumferential groove 92*a* located at the top of the threaded shank 52*a* adjacent the head 50*a*. The head includes a concentric, internally wrenched socket 94*a* (e.g., configured for an Allen wrench or a six-point, star-shaped driver sold under the trademark TORX®, etc.) therein, which extends into the shank portion 52*a* some distance beyond the external circumferential groove 92*a*. It will be seen that the torsional and tensile strength of the mechanical fuse fastener 46*a* is defined by the cross sectional area between the circumferential groove 92*a* and the internal socket 94*a*, which defines a fracture section of the fuse 46*a*. When tensile stress applied to the fuse 46*a* through a load placed on the door and resulting action of the door arm 54 and hinge plate 28 equals or exceeds the fracture stress of the fuse 46*a*, the fuse 46*a* fails at the fracture section. The groove 92*a* and/or socket 94*a* diameter(s) may be configured in order to arrive at the desired amount of material therebetween, thus adjusting the torsional and tensile strength of the bolt 46*a* as desired. The depth of the internal socket 94*a* permits a wrench (e.g., Allen wrench or a six-point, star-shaped driver sold under the trademark TORX®, etc.) to be inserted into the remaining socket depth even after the head 50*a* has separated from the shank portion 52*a*, thereby facilitating withdrawal of the shank 52*a* from the mechanical fuse attachment hole 36 formed within the lug 34 of the hinge plate 28.

Figure 3B:
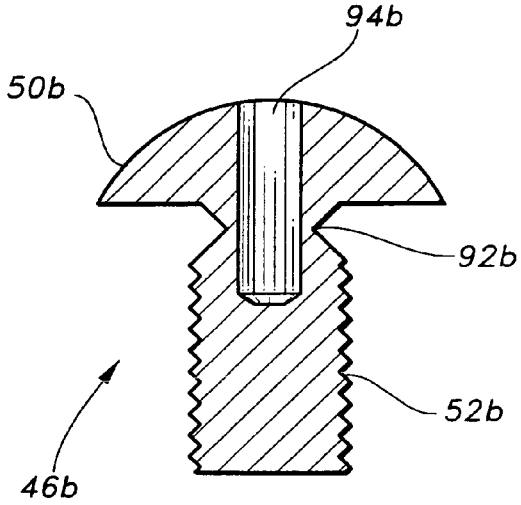
FIG. 3B is an enlarged side elevation view in section of an alternative embodiment mechanical fuse bolt for use in a load limiting hinge assembly of the present invention.

FIG. 3B illustrates a cross-sectional view of an alternative mechanical fuse fastener 46*b*. The head 50*b* of the fastener 46*b* is devoid of external flats or other external wrenching means thereon, but includes an internal wrenching socket 94*b*. The internal socket 94*b* permits the same tool to be used for both the installation of the fastener 46*b*, and the withdrawal of the shank 52*b* after the head 50*b* becomes separated therefrom. The mechanical fuse fastener 46*b* of FIG. 3B also includes a circumferential groove, i.e., groove 92*b*, but it will be noted that the groove 92*b* has a triangular or V-shaped cross section with a sharp bottom, rather than the rounded, semicircular cross section of the groove 92*a* of the mechanical fuse 46*a* of FIG. 3A. The sharper cross section of the groove 92*b* creates a stress riser, which can facilitate breakage of the mechanical fuse 46*b* precisely along the bottom of the groove and at the specific predetermined breaking strength desired.

Figure 3C:
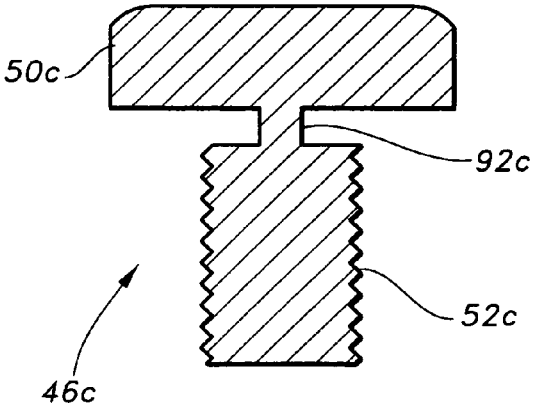
FIG. 3C is an enlarged side elevation view in section of another alternative embodiment mechanical fuse bolt for use in a load limiting hinge assembly of the present invention.

FIG. 3C illustrates yet another variation of a mechanical fuse, designated as mechanical fuse 46*c*. The mechanical fuse fastener 46*c* also includes an externally wrenched head 50*c* and a circumferential groove 92*c* between the head and the shank 52*c*, but is devoid of any internal wrenching socket. While such a fastener may be installed conventionally, the lack of any internal wrench socket increases the difficulty of removing the shank 52*c* after separation of the head 50*c* therefrom. Still, this may be desirable in certain applications where inspection of the appliance and hinge by a specialist is desired before mechanical fuse replacement and returning the appliance to use. The use of such a fastener as the mechanical fuse 46*c* precludes replacement of the fastener 46*c* by the average homeowner. Nevertheless, the use of a mechanical fuse fastener without an internal wrenching socket may be desirable in order to provide a greater moment of inertia for the material within the circumferential groove, thereby increasing the torsional strength of the fastener for driving.

It will also be noted that the circumferential groove 92*c* of the mechanical fuse 46*c* has a square cross section. The intent here is to show that virtually any cross sectional shape may be used to form the circumferential groove, as desired. For that matter, virtually any head configuration may be used as desired, e.g., flat heads for use in countersunk holes, etc. The three mechanical fuse fasteners 46*a* through 46*c* illustrated in FIGS. 3A through 3C are exemplary, and are not intended to limit the vast array of configurations, including shear pins, which may be used with the present load limiting hinge invention.

It is envisioned that most such mechanical fuse fasteners would be formed of a high strength ferrous metal of some sort, e.g., steel. This would allow the internal wrenching socket to be formed to have a reasonable internal diameter, without unduly increasing the external diameter of the threaded shank portion of the fastener. However, softer and less durable metals may be used, so long as consideration is given for their tensile strengths and the cross-sectional areas of the material between their circumferential grooves and internal sockets (if any). For that matter, such mechanical fuses could be formed of plastic materials, if desired, so long as their sizes are adjusted in accordance with the tensile strength required. However, it is envisioned that metals, and particularly relatively brittle metals, are the preferred materials for such fasteners, due to the sudden failure mode of such materials with little or no elongation (and therefore little or no deflection of the door arm and door) prior to failure.

Figure 4:
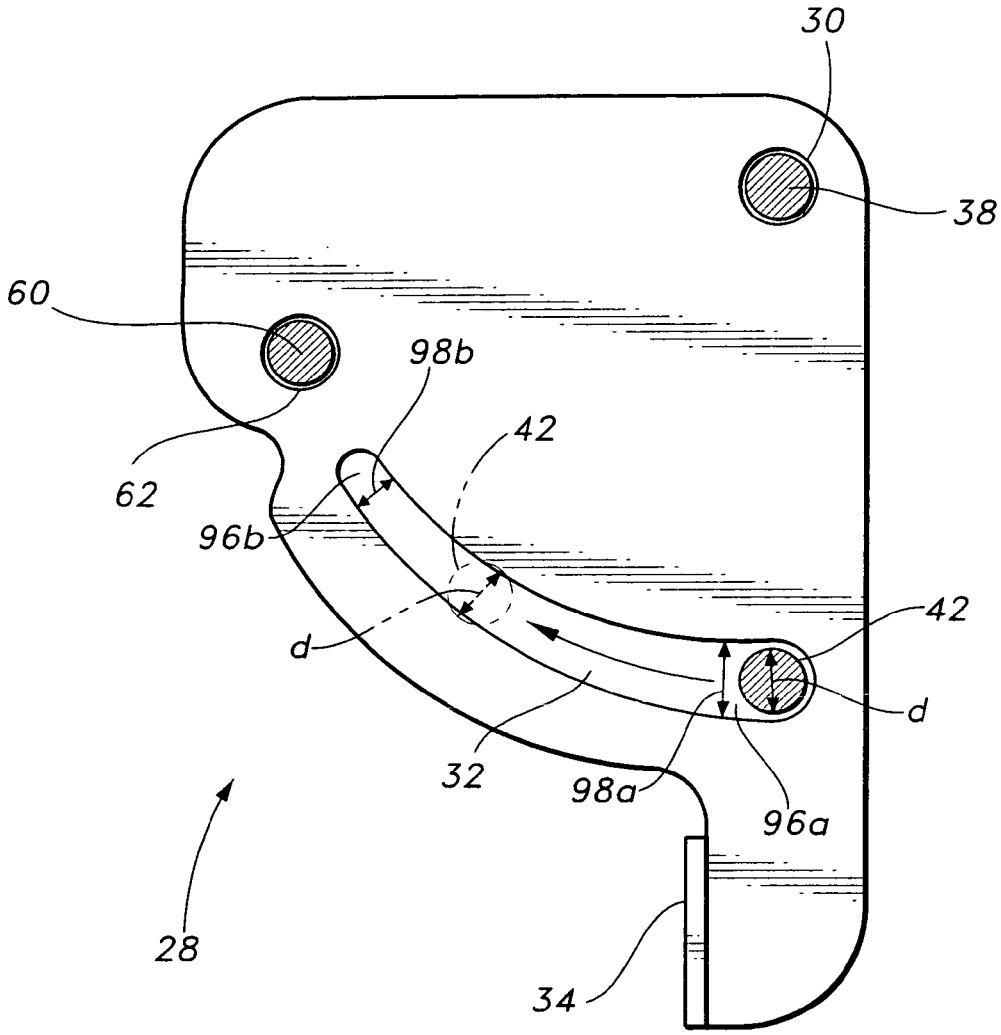
FIG. 4 is a detailed side elevation view of the hinge plate of the load limiting hinge assembly of the present invention, showing the configuration of the arcuate slot therein and other details.

FIG. 4 provides a detailed view of the hinge plate 28 of the present load limiting hinge 10. It will be noted in FIG. 4 that the arcuate pivot limit slot 32 is not a constant width from end to end. The slot 32 has a first end 96*a* with an internal width 98*a* which is slightly greater than the diameter d of the fastener 42 (bolt, rivet, etc.). However, the width of the slot 32 narrows from its first end 96*a* to its opposite second end 96*b*, with the internal width 98*b* near the second end 96*b* tapering to less than the diameter d of the fastener 42. This allows the hinge plate 28 to initially pivot smoothly about its pivot fastener 38 when the mechanical fuse 46 breaks, without being restrained by the sides of the slot 32 bearing against the hinge plate pivot limit fastener 42. However, as the plate 28 continues to pivot, the pivot limit fastener 42 in effect moves toward the narrower second end 96*b* of the slot 32. The narrower width of the slot 32 toward its second end 96*b* bears against the fastener 42, thereby slowing the rotational movement of the hinge plate 28 and thus slowing the drop of the door arm 54 and door attached thereto. This also tends to jam the hinge plate 28 into position as shown in FIG. 2D, which lessens the ability of the tension spring 78 to rotate the assembly (and door) back to its original position, thus greatly reducing the possibility that the door extending from the door arm 54 will bounce rapidly back to its closed position and possibly inflict injury to a person nearby.

Figure 5:
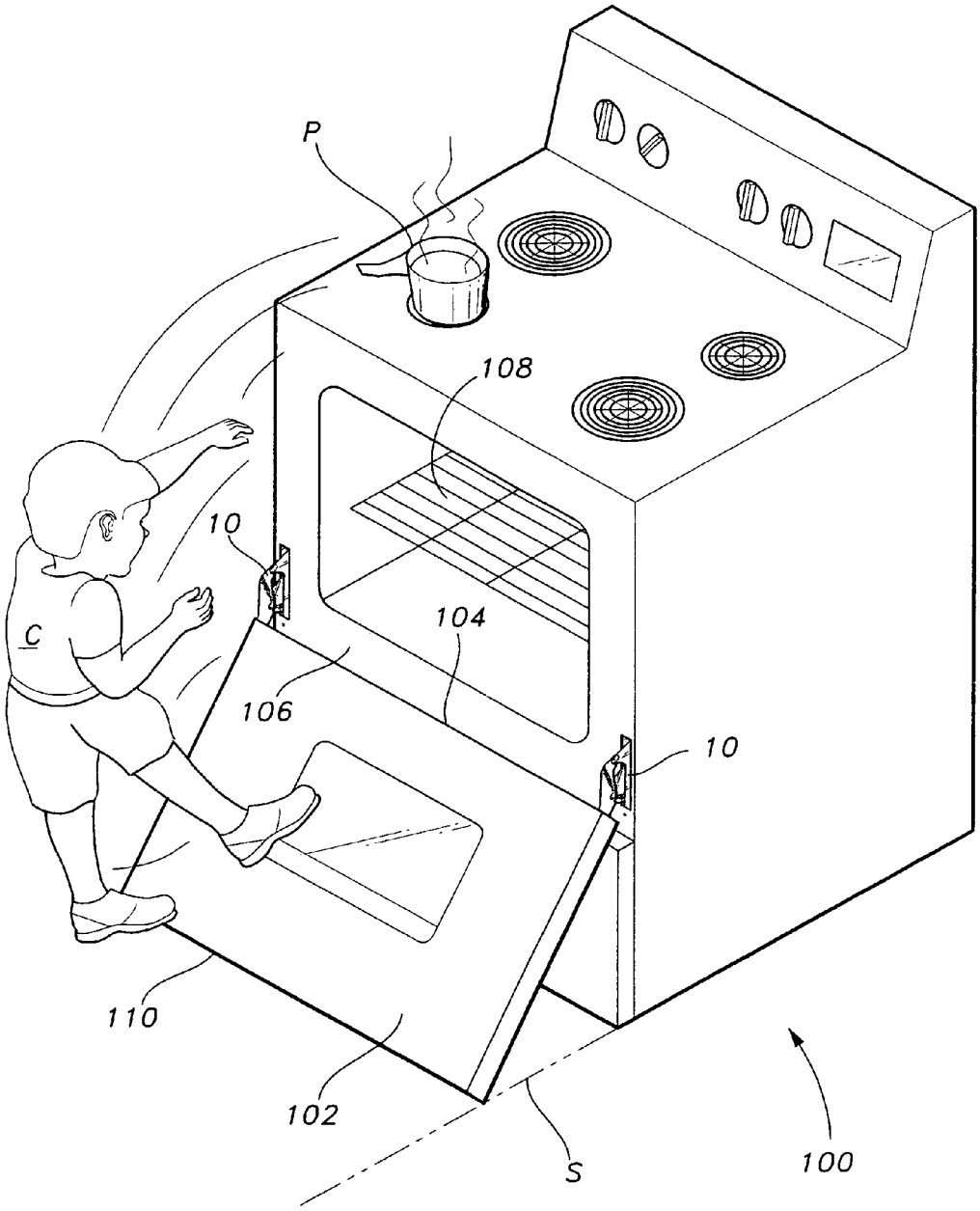
FIG. 5 is an environmental perspective view showing the results of excessive force on the door of an oven equipped with a load limiting hinge assembly of the present invention.

FIG. 5 provides an environmental perspective view of an oven or range 100 with a drop down door 102 having a lower edge 104 pivotally secured to the lower edge 106 of the open front 108 of the oven by a pair of the load limiting hinges 10. (Such hinges 10 may be configured in mirror image to one another, but the structure and the function described further above remain the same.) In FIG. 5, a toddler or small child C has attempted to access a heated container or pot P atop the cook top of the oven or range 100 by standing on the open door 102. (More than one child is often involved in such events.) The weight of the child C, or children, particularly when applied toward the outer edge 110 of the door 102, i.e., the edge opposite the lower edge 104, is generally sufficient to cause the mechanical fuse 50 of each hinge assembly 10 to break in tension, resulting in the upper or outer edge 110 of the door 102 dropping to the underlying surface S as the hinge plate 28 (FIGS. 1 through 2D and 4) rotates about its hinge plate pivot fastener 38, along with the respective door arm 54. As a result, the child(ren) or toddler(s) C falls back from the now sloping door 102, thereby precluding potentially extremely serious burns from the cook top of the oven 100 or from heated articles thereon. The dropping of the oven door 102 due to the breakage of the mechanical fuses within the hinges 10 also precludes the tipping of the oven 100, and subsequent spillage of heated articles atop the oven, in the event that the oven 100 was not properly anchored to the underlying surface.

Figure 6:
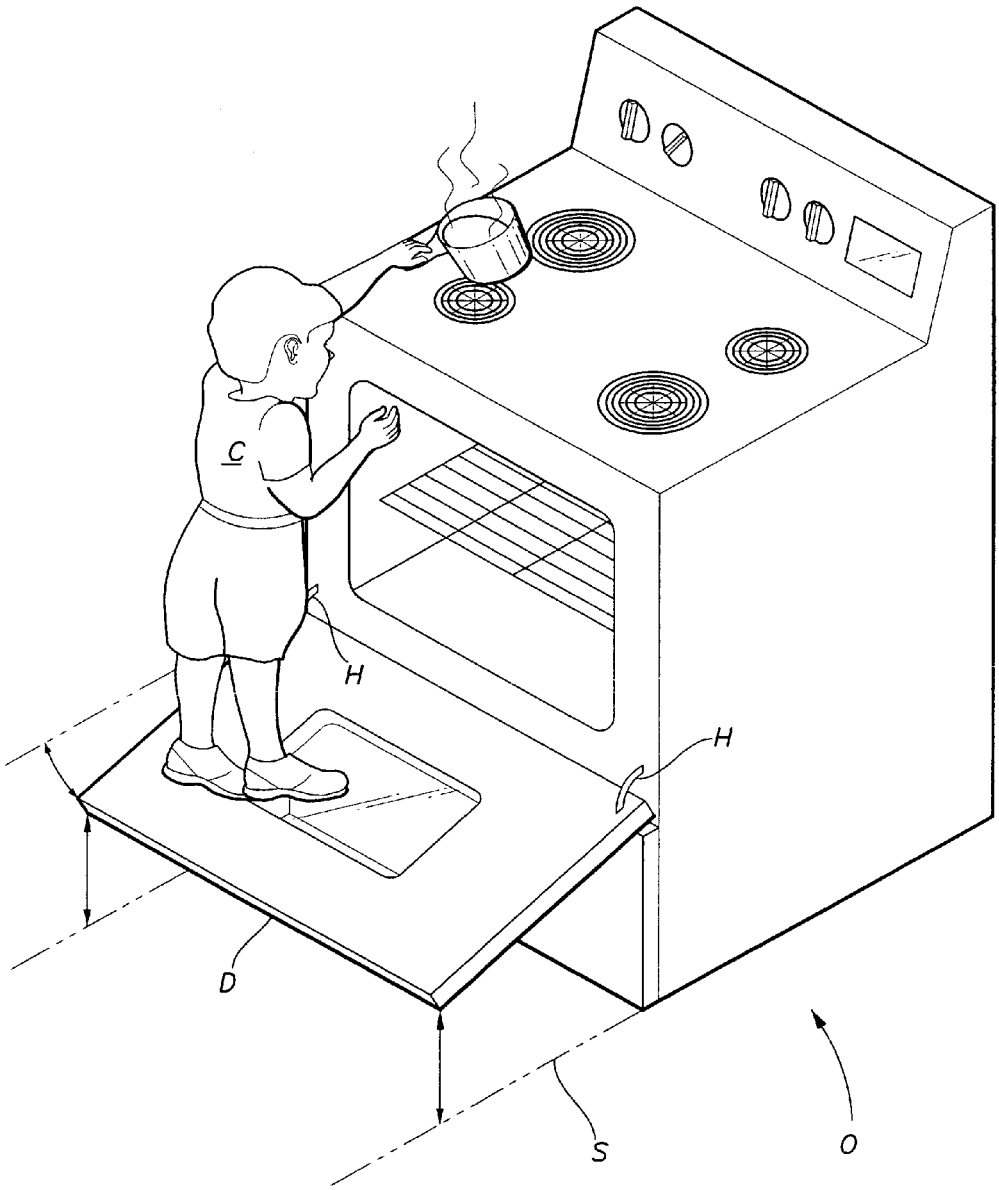
Fig. 6 (PRIOR ART)
FIG. 6 is an environmental perspective view of an oven equipped with a prior art door hinge assembly, allowing only partial deflection of the door beyond the horizontal when excessive loads are placed on the door.

FIG. 6 is an environmental perspective view of a prior art oven O, which is not equipped with load limiting hinges. In FIG. 6, the small child C is able to use the oven door D as a platform to access heated articles on the cook top, thereby risking potentially extremely serious and possibly even life threatening burns. The oven door hinges H do not provide any form of load limiting protection, restricting the movement of the door D to only a slight deflection and holding the door D essentially horizontal with the outer or upper edge of the door D suspended well above the underlying surface S. Accordingly, such a conventional door D and hinge assembly H can serve as a platform for relatively high loads before damage occurs sufficient to cause the door to collapse, with the load in many cases being sufficient to cause the entire oven O to tip forward toward the open door D, thereby spilling any heated articles or contents atop the cook top of the oven.

In conclusion, the load limiting hinge of the present invention provides a much improved means of providing safety for small children and others who may misuse an appliance, such as an oven or the like. It should be noted that the load limiting hinge is adaptable for use in a number of different environments and installations and is particularly suitable for use in appliances with drop down doors, e.g., clothes dryers and ovens. The load limiting hinge is particularly valuable in oven installations, due to: (1) the suitability of the hinge configuration for use in relatively heavy oven doors; and (2) the potential hazard of spillage of heated materials from the cook top of the oven. The load limiting hinge provides a release of the oven door from the horizontal before excessive weight may be applied thereto, thereby precluding tipping of an unanchored oven and/or access to the cook top by a small child by using the open, horizontal oven door. The hinge is economical to manufacture and install, requiring little more in the manner of parts and labor than conventional hinges. The mechanical fuse of the present hinge is also easily replaced when broken, particularly where internally wrenched fasteners are used. Thus, the load limiting hinge will prove to be an extremely valuable component in the ovens and similar appliances of most appliance manufacturers, potentially saving vast amounts when the potential liability problems of existing conventional hinges are considered.

It is to be understood that the present invention is not limited to the embodiments described above, but encompasses any and all embodiments within the scope of the following claims.

The invention claimed is:

1. A load limiting hinge, comprising:

a substantially rigid hinge post having a hinge plate attachment portion, a spring attachment end opposite the hinge plate attachment portion, said hinge post having hinge plate pivot and hinge plate locking holes defined therein;

said hinge post further including a hinge plate pivot limit fastener hole defined therein;

a substantially rigid hinge plate having a pivot attachment hole, a door arm attachment hole, and threaded mechanical fuse attachment hole defined therein;

said hinge plate having a pivot limit slot in the shape of an arc formed therein, the center of the arc of the pivot limit slot being located at the pivot attachment hole of said hinge plate;

a hinge plate pivot limit fastener extending through the hinge plate pivot limit fastener hole of said hinge post and the pivot limit slot of said hinge plate;

an elongate, substantially rigid door arm having a hinge plate attachment end with a hinge plate attachment hole defined therein;

a hinge plate pivot fastener extending through the hinge plate pivot hole and the pivot attachment hole, pivotally attaching the hinge plate to the hinge post;

a door arm pivot fastener extending through the door arm attachment hole and the hinge plate attachment hole, pivotally attaching the door arm to the hinge plate; and a threaded mechanical fuse extending through the hinge plate locking hole and the mechanical fuse attachment hole, the fuse having a fracture stress so that the fuse immovably affixes the hinge plate to the hinge post under normal load, and fractures when an excessive load applied to the door arm exerts tensile stress to fracture the fuse and pivot the hinge plate about the hinge plate pivot fastener.

2. The load limiting hinge according to claim 1, wherein:

said hinge post has a hinge plate pivot attachment wall and a hinge plate locking wall substantially normal to the hinge plate pivot attachment wall, the hinge plate locking wall having a door arm extension side and a hinge plate attachment side opposite the door arm extension side;

said hinge plate has a mechanical fuse attachment lug extending substantially normal thereto, the threaded mechanical fuse attachment hole being defined in the lug; and said mechanical fuse has a head positioned adjacent the door arm extension side of the hinge plate locking wall and a shank extending through the hinge plate locking wall and attachment lug, the shank being held in tension.

3. The load limiting hinge according to claim 1, wherein said hinge post has a hinge plate pivot wall and a hinge plate locking wall substantially normal to the hinge plate pivot wall, the hinge plate locking wall having a door arm and hinge plate clearance slot defined therein, said door arm and said hinge plate extending partially through the clearance slot.

4. The load limiting hinge according to claim 1, wherein said hinge plate pivot limit fastener defines a diameter, the pivot limit slot of said hinge plate having a first end wider than the diameter of said hinge plate pivot limit fastener and a second end narrower than the diameter of said hinge plate pivot limit fastener, the width of the pivot limit slot tapering from the first end to the second end thereof.

5. The load limiting hinge according to claim 1, wherein said mechanical fuse is selected from the group consisting of externally wrenched bolts, internally wrenched bolts, and bolts both externally and internally wrenched.

6. The load limiting hinge according to claim 1, wherein said mechanical fuse is formed of material selected from the group consisting of ferrous metal, non-ferrous metal, and plastic.

7. A load limiting hinge, comprising:

a substantially rigid hinge post having a hinge plate attachment portion, a spring attachment end opposite the hinge plate attachment portion, and hinge plate pivot and hinge plate locking holes defined therein;

said hinge post further has a hinge plate pivot limit fastener hole defined therein;

a substantially rigid hinge plate having a pivot attachment hole, a door arm attachment hole, and threaded mechanical fuse attachment hole defined therein;

an elongate, substantially rigid door arm having a hinge plate attachment end with a hinge plate attachment hole defined therein;

a hinge plate pivot fastener extending through the hinge plate pivot hole and the pivot attachment hole, pivotally attaching the hinge plate to the hinge post;

a door arm pivot fastener extending through the door arm attachment hole and the hinge plate attachment hole, pivotally attaching the door arm to the hinge plate;

a slider bar attachment arm extending from said door arm, the slider bar attachment arm having a slider bar attachment hole defined therein;

an elongate, substantially rigid slider bar having a door arm attachment end and a hinge post contact end opposite the door arm attachment end, the hinge post contact end slidably bearing against said hinge post;

a door arm attachment lug extending from the door arm attachment end of said slider bar, the door arm attachment lug having a door arm attachment hole defined therein;

a door arm and slider bar connection fastener disposed through said slider bar attachment hole of said door arm and through said door arm attachment hole of said slider bar; and a threaded mechanical fuse extending through the hinge plate locking hole and the mechanical fuse attachment hole, the fuse having a fracture stress so that the fuse immovably affixes the hinge plate to the hinge post under normal load, and fractures when an excessive load applied to the door arm exerts tensile stress to fracture the fuse and pivot the hinge plate about the hinge plate pivot fastener.

8. The load limiting hinge according to claim 7, further including:

a spring attachment arm extending from the door arm attachment end of said slider bar, opposite said door arm attachment lug; and a tension spring secured to said spring attachment arm of said slider bar and to the spring attachment end of said hinge post, urging said slider bar toward the spring attachment end of said hinge post.

9. The load limiting hinge according to claim 7, further including, a hinge plate pivot limit fastener extending through the hinge plate and the hinge post, the hinge plate pivot limit fastener and the door arm and slider bar connection fastener each being a rivet.

10. An oven with load limiting hinge, comprising:

an oven having an open front with a lower edge;

a drop down door disposed at the open front of the oven, said door having a lower edge;

a pair of hinge assemblies connecting the lower edge of said door with the lower edge of the front of said oven, each of said hinge assemblies comprising:

a substantially rigid hinge post having a hinge plate attachment portion and a spring attachment end opposite the hinge plate attachment portion, said hinge post further having a hinge plate pivot limit fastener hole defined therein;

a substantially rigid hinge plate, said hinge plate having an arcuate pivot limit slot defined therein;

a hinge plate pivot limit fastener extending through the hinge plate pivot limit fastener hole of said hinge post and the pivot limit slot of said hinge plate;

an elongate, substantially rigid door arm pivotally attached to the hinge plate, the door being attached to the door arm; and a pivot fastener pivotally attaching a first end of the hinge plate to the hinge post and a threaded mechanical fuse having a fracture stress, the fuse immovably affixing a second end of the hinge plate to the hinge post under normal load, and fracturing when an excessive load is applied to the door arm and exerts tensile stress sufficient to fracture the fuse and pivot the hinge plate about the pivot fastener.

11. The oven according to claim 10, wherein:

said hinge post further comprises a hinge plate pivot attachment wall and a hinge plate locking wall substantially normal to the hinge plate pivot attachment wall;

said hinge plate further includes a mechanical fuse attachment lug extending substantially normal thereto; and said mechanical fuse further includes a head positioned adjacent the hinge plate locking wall and a shank extending through the lug and held under tension.

12. The oven according to claim 10, wherein said hinge post has a hinge plate pivot wall and a hinge plate locking wall substantially normal to the hinge plate pivot wall, the hinge plate locking wall having a door arm and hinge plate clearance slot defined therein, said door arm and said hinge plate extending partially through the clearance slot.

13. The oven according to claim 10, wherein:

said hinge plate pivot limit fastener has a diameter; and the pivot limit slot of said hinge plate has a first end with a width greater than the diameter of said hinge plate pivot limit fastener and a second end with a width less than the diameter of said hinge plate pivot limit fastener, with the width of the pivot limit slot tapering from the first end to the second end thereof.

14. A load limiting hinge, comprising:

a substantially rigid hinge post;

a substantially rigid hinge plate having a first end pivotally attached to the hinge post and having a second end;

an elongate, substantially rigid door arm pivotally attached to the hinge plate, the door arm having a door attachment end, the door arm pivoting between a closed position in which the door attachment end is substantially parallel to the hinge post and an open position in which the door attachment end is substantially normal to the hinge post, the door arm having a stop bearing against the hinge plate when the door arm is in the open position;

means for biasing the door arm in the closed position; and a fuse bolt having a head, a shank, and a groove defining a narrow diameter fracture section in the shank adjacent the head, the fuse bolt rigidly attaching the second end of the hinge plate to the hinge post, the fuse bolt having a fracture stress defined by the fracture section so that the fuse bolt fractures when a tensile stress equal to the fracture stress is applied to the bolt by a load applied to the door arm, the hinge plate pivoting so that the door attachment end of the door arm pivots more than 90° relative to the hinge post, the means for biasing being disabled.

15. The load limiting hinge according to claim 14, wherein the head of said fuse bolt has a socket defined therein adapted for receiving a torquing tool, the socket extending into the fracture section, whereby the fracture section is hollow.

16. The load limiting hinge according to claim 15, wherein the socket is hexagonal-shaped, the head being adapted for receiving an Allen wrench.

17. The load limiting hinge according to claim 15, wherein the socket is star-shaped, being adapted for receiving a star-shaped driver.

18. The load limiting hinge according to claim 14, further comprising means for guiding and limiting the pivoting of said hinge plate upon fracture of said fuse bolt.

* * * * *